US005363919A

United States Patent [19]

Jennings, Jr.

[11] Patent Number: 5,363,919

[45] Date of Patent: Nov. 15, 1994

[54] SIMULTANEOUS HYDRAULIC FRACTURING USING FLUIDS WITH DIFFERENT DENSITIES

[75] Inventor: Alfred R. Jennings, Jr., Plano, Tex.

[73] Assignee: Mobil Oil Corporation, Fairfax, Va.

[21] Appl. No.: 151,628

[22] Filed: Nov. 15, 1993

[51] Int. Cl.[5] ..... E21B 43/26

[52] U.S. Cl. ..... 166/308; 166/250; 166/269

[58] Field of Search ..... 166/308, 269, 250, 281, 166/282, 271

[56] References Cited

U.S. PATENT DOCUMENTS

| | | | |
|---|---|---|---|
| 2,837,163 | 6/1958 | Ramos et al. | 166/269 X |
| 3,954,142 | 5/1976 | Broaddus et al. | 166/308 X |
| 3,965,982 | 6/1976 | Medlin | 166/249 |
| 4,067,389 | 1/1978 | Savins | 166/246 |
| 4,249,609 | 2/1981 | Haafkens et al. | 166/280 |
| 4,378,845 | 4/1983 | Medlin et al. | 166/297 |
| 4,387,770 | 6/1983 | Hill | 166/269 X |
| 4,392,530 | 7/1983 | Odeh et al. | 166/269 |
| 4,415,035 | 11/1983 | Medlin et al. | 166/308 |
| 4,415,805 | 11/1983 | Fertl et al. | 250/260 |
| 4,515,214 | 5/1985 | Fitch et al. | 166/250 |
| 4,549,608 | 10/1985 | Stowe et al. | 166/280 |
| 4,867,241 | 9/1989 | Strubhar | 166/308 |
| 5,018,578 | 5/1991 | Rabaa et al. | 166/308 X |

*Primary Examiner*—Stephen J. Novosad
*Attorney, Agent, or Firm*—Alexander J. McKillop; George W. Hager, Jr.; Charles A. Malone

[57] ABSTRACT

Two spaced apart zones of a formation are simultaneously hydraulically fractured. A lower density fracturing fluid is injected into an upper zone of the formation via an annulus of a perforated wellbore communicating with the upper zone thereby causing a fracture to propagate. Simultaneously therewith, a higher density fracturing fluid is injected into a lower spaced apart zone via a tube within the wellbore which fluidly communicates with the lower zone thereby causing simultaneously the propagation of a second fracture. Neither fracture contacts the other although complete fracture growth is obtained.

6 Claims, 1 Drawing Sheet

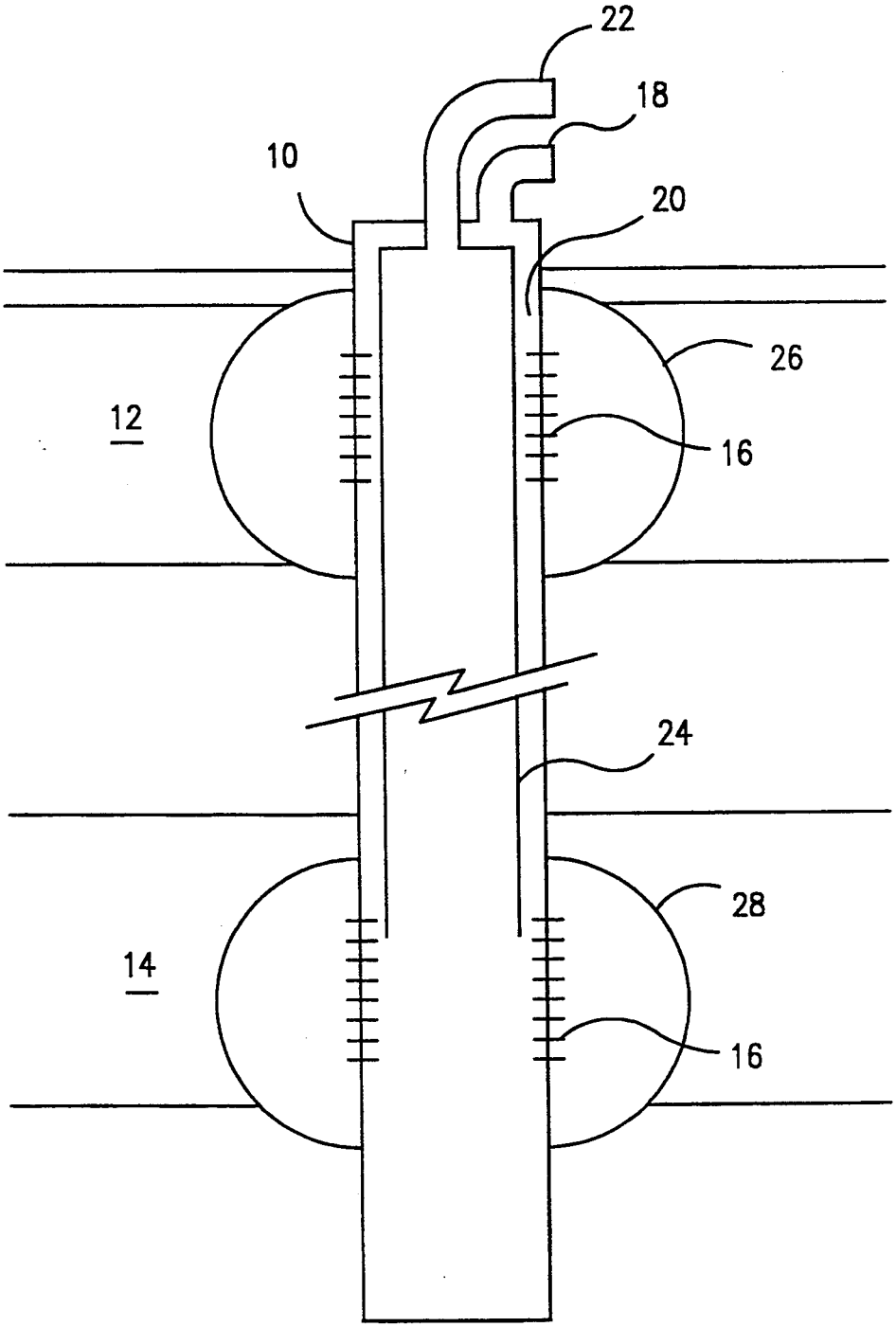
22
18
10
20
26
12
16
24
28
14
16

SIMULTANEOUS HYDRAULIC FRACTURING USING FLUIDS WITH DIFFERENT DENSITIES

FIELD OF INVENTION

This invention relates to methods for fracturing a subterranean formation and, more particularly, to a new method for fracturing a formation surrounding a wellbore with fluids of different densities.

BACKGROUND OF THE INVENTION

In the completion of wells built into the earth, a string of casing is normally run into the well and a cement slurry is flowed into the annulus between the casing string and the wall of the well. The cement casing slurry is allowed to set and form a cement sheath which bounds the string of casing to the wall of the well. Perforations are provided through the casing and a cement sheath adjacent the sub-surface formation. Fluids, such as oil or gas, are produced through these perforations into the well.

Hydraulic fracturing is widely practiced to increase the production rate from such wells. Fracturing treatments are usually performed soon after the formation interval to be produced is completed, that is, soon after fluid communication between the well and the reservoir interval is established. Wells are also sometimes fractured for the purpose of stimulating production after significant depletion of the reservoir.

Hydraulic fracturing techniques involve injecting a fracturing fluid down a well and into contact with the subterranean formation to be fractured. Sufficiently high pressure is allowed to the fracturing fluid to initiate and propagate a fracture into the subterranean formation. Proppant materials are generally entrained in the fracturing fluid and are deposited in the fracture to maintain the fracture open.

Several such hydraulic fracturing methods are disclosed is U.S. Pat. Nos. 3,965,982; 4,067,389; 4,378,845; 4,515,214; and 4,549,608 for example. It is generally accepted that the in-situ stresses in the formation at the time of such hydraulic fracturing generally favor the formation of vertical fractures in preference to horizontal fractures.

Wells completed through formations at multiple intervals always present a challenge for effective treatment. Frequently, various methods of zone isolation or diverting will be used in treating more than one well, especially if the zones of interest are separated by a few hundred feet. Wells which are perforated over several hundred feet in a single zone also create a challenge to treat effectively with well stimulation such as acidizing or hydraulic fracturing.

Therefore, what it is needed is a method for hydraulically fracturing a formation having multiple intervals or zones which method does not require zone isolation.

SUMMARY OF THE INVENTION

This invention is directed to a method for simultaneously hydraulically fracturing two spaced apart zones of a formation. A lower density fracturing fluid is injected into an upper zone of said formation via an annulus within a perforated wellbore. Perforating the wellbore causes it to communicate fluidly with the upper zone. The lower density fracturing fluid is injected at a pressure sufficient to initiate and propagate a first fracture within the upper zone. While injecting the lower density fracturing fluid into the upper zone, a higher density fracturing fluid is injected by a tubing string within the wellbore into a lower spaced apart zone of the formation.

Perforations contained in the wellbore allow fluid communication with the lower zone so as to permit the fracturing fluid to enter therein. The higher density fracturing fluid enters the lower zone at a pressure and rate sufficient to simultaneously initiate and propagate another fracture within the lower zone. Neither fracture contacts the other fracture. Complete fracture growth is obtained in each zone while each fracture in that zone is confined to its own zone.

It is therefore an object of this invention to ensure complete zonal coverage when hydraulically fracturing a formation at different spaced apart zones.

It is another object of this invention to minimize the effects of problematic fracture growth which occur which sequential fracturing in spaced apart zones.

It is a further object of this invention to minimize fracturing costs by simultaneously making two fractures at two spaced apart zones while conducting one fracturing operation.

It is another further object of this invention to provide for a simultaneous hydraulic fracturing method for spaced apart zones which method does not require a mechanical packer.

BRIEF DESCRIPTION OF THE DRAWING

The drawing is a schematic representation of a perforated wellbore in which hydraulic fracturing has been simultaneously conducted at two different spaced apart intervals of the formation.

DESCRIPTION OF THE PREFERRED EMBODIMENT

Referring now to the drawing, wellbore 10 has penetrated upper zone 12 and lower zone 14. Lower zone 14 is separated from upper zone 12 by a distance of about 50 to about 300 feet or more. Wellbore 10 communicates fluidly with upper zone 12 and lower zone 14 by perforations 16. An annular space or annulus 20 is formed via the outside wall of wellbore 10 and a tubing string 24 centrally located within the wellbore. Tubing string 24 communicates fluidly with the surface via tubing string conduit 22. Tubing string conduit 22 communicates fluidly with a "frac" fluid supply means (not shown) and a pumping means (not shown). Annulus or annular space 20 fluidly communicates to the surface via annulus conduit 18. Annulus conduit 18 is connected to a "frac" fluid supply means (not shown) and a pumping means (not shown).

In order to create two simultaneous fractures at different spaced apart zones of the formation, a hydraulic fracturing fluid is directed down annulus conduit 18 so as to enter upper zone 12 through perforations 16. Hydraulic fracturing pressure is applied while simultaneously directing a fracturing fluid which is heavier than the first fracturing fluid into tubing string 24 via tubing string conduit 22. The heavier fracturing fluid is directed by tubing string 24 into lower interval or zone 14 via perforations 16. Hydraulic fracturing fluid is continually directed into annulus conduit 18 and tubing string conduit 22 so as to simultaneously enter upper zone 12 and lower zone 14 respectively. The rate and pressure of the hydraulic fracturing fluid entering upper zone 12 and lower zone 14 is at a rate and pressure sufficient to simultaneously create within upper zone 12 one fracture 26 while simultaneously creating another fracture 28 in lower zone 14. Tubing string 24 is open-ended where it is located in an area adjacent to perforations 16 in wellbore 10 within lower zone 14.

As fracture 26 which is created in upper zone 12 propagates through that zone, it completely covers that zone. Additionally, since a lighter density hydraulic fracturing fluid is utilized in upper zone 12, less pressure is generated in that zone so the fracture does not propagate out of zone 12. Less fracturing force is required because less pressure is generated in zone 12 because its depth is less than that in zone 14. Because lower zone 14 is at a greater depth, a higher density "frac" fluid is needed to generate greater pressures in zone 14. Thus, fracture 28 does not propagate upwardly into zone 12 and problematic fracture growth is eliminated. If the fracture created in zone 12 does communicate with the fracture in zone 14, density differences will help keep fluids separated into their respective zones.

Since the hydraulic fracturing fluid of a lighter density is entering upper formation 12 at the same time that a heavier fracturing fluid is entering lower zone 14, with substantially the same injection rate and pressure without co-mingling of the fracturing fluids, a mechanical packer is therefore not required to separate upper zone 12 from lower zone 14. Since both zones are being simultaneously hydraulically fractured, only one fracturing operation need be conducted in both zones. Conducting one hydraulic fracturing operation in both zones at the same time saves both time and money.

The effectiveness of fracturing at each zone of the formation can be determined by available methods. One such method is described in U.S. Pat. No. 4,415,805 that issued to Fertl et al. This patent is incorporated herein by reference. This method describes a multiple stage formation operation conducted with separate radioactive tracer elements injected into the well during the fracturing operation. After completion of the fracturing operation, the well is logged using natural gamma ray logging. The resulting signals are sorted into individual channels or energy bands characteristic of each separate radio tracer element. Results of the simultaneous fracturing operation are evaluated based on disbursement of the individual tracer elements.

Wellbore 10 can be cased or uncased. If the wellbore is cased, the casing is cemented into wellbore 10. Thereafter, the casing is selectively perforated in a manner so that in subsequent treatments, fluids being pumped therein will pass through all perforations at a substantial rate. While the pumping rate of the hydraulic fracturing fluid is formation dependent, it should be at least about 1 to about 10 barrels per fracture. Perforations are made within wellbore 10 at a spacing of about 10 to about 100 feet apart so a desired fracture spacing can be obtained. These perforations should comprise two sets of perforations which are simultaneously formed on opposite sides of wellbore 10. Preferably, these perforations should have diameters between about $\frac{1}{4}$ to about 1 inch. They should be placed circumferentially about the casing in the anticipated plane where it is desired to induce a fracture into the zone. The number and size of perforations are determined by the fracture treatment pumping rate and the pressure drop necessary to divert sufficient fluid through all the perforations to create simultaneously fractures in the upper and lower zones.

Fracture fluids which can be utilized herein include simple Newtonian fluids, gels described as Power Law fluids, and acids. Use of acids as a fracturing fluid is discussed in U.S. Pat. No. 4,249,609 issued to Haafkens et al. on Feb. 10, 1981. This patent is herein incorporated by reference. Use of a gel as a fracturing fluid is disclosed in U.S. Pat. No. 4,415,035 issued to Medlin et al. on Nov. 15, 1983. This patent is herein incorporated by reference. These fracturing fluids as well as a method for fracturing a formation by limited entry is disclosed in U.S. Pat. No. 4,867,241 issued to Strubhar on Sep. 19, 1989. This patent is hereby incorporated herein by reference.

Although the present invention has been described with preferred embodiments, it is to be understood that modifications and variations may by resorted to without departing from the spirit and scope of this invention, as those skilled in the art will readily understand.

What is claimed:

1. A method for simultaneously hydraulically fracturing two spaced apart zones of a formation comprising:

a) injecting a lower density fracturing fluid into an upper zone of said formation via an annulus of a perforated wellbore communicating with said upper zone which fluid is injected at a pressure sufficient to initiate and propagate a first fracture within said upper zone; and b) simultaneously injecting with the fracturing fluid of step a), a higher density fracturing fluid into a lower spaced apart zone of said formation via an injection tube within the perforated wellbore that communicates fluidly with said lower zone which fluid is injected at a pressure sufficient to simultaneously initiate and propagate another fracture within said lower zone without mechanically isolating the zones from each other.

2. The method as recited in claim 1 where the lower and upper zones are spaced about 50 to about 300 feet apart.

3. The method as recited in claim 1 wherein the density of the higher density fracturing fluid is about 0.5 pounds per gallon heavier than the lower density fracturing fluid.

4. The method as recited in claim 1 where the injection tube is open-ended.

5. The method as recited in claim 1 where the lower and higher density fracturing fluids do not co-mingle while fracturing the zones.

6. The method as recited in claim 1 where the lower and higher density fracturing fluids are retained in their respective zones when contacting each other because of a density difference between the fluids.

* * * * *